US006362726B1

(12) United States Patent
Chapman

(10) Patent No.: US 6,362,726 B1
(45) Date of Patent: Mar. 26, 2002

(54) SOUNDER DEVICE WHICH DEFLECTS SOUND AWAY FROM A HOUSING

(75) Inventor: Kieron Chapman, Cwmbran (GB)

(73) Assignee: Fulleon Limited, Gwent (GB)

( * ) Notice: Subject to any disclaimer, the term of this patent is extended or adjusted under 35 U.S.C. 154(b) by 0 days.

(21) Appl. No.: 09/367,706

(22) PCT Filed: Feb. 25, 1998

(86) PCT No.: PCT/GB98/00604

§ 371 Date: Oct. 25, 1999

§ 102(e) Date: Oct. 25, 1999

(87) PCT Pub. No.: WO98/38608

PCT Pub. Date: Sep. 3, 1998

(30) Foreign Application Priority Data

Feb. 27, 1997 (EP) ..... 9704066

(51) Int. Cl.[7] ..... G08B 3/10

(52) U.S. Cl. ..... 340/384.7; 340/321; 340/326; 340/629; 340/630; 340/692; 340/693

(58) Field of Search ..... 340/384.7, 326, 340/321, 629, 630, 692, 693

(56) References Cited

U.S. PATENT DOCUMENTS

| | | | | | |
|---|---|---|---|---|---|
| 3,569,963 | A | | 3/1971 | Mallory et al. | 340/384 |
| 3,686,605 | A | * | 8/1972 | Hire | 337/334 |
| 3,934,145 | A | * | 1/1976 | Dobrzanski et al. | 250/381 |
| 4,090,178 | A | | 5/1978 | Norris | 340/220 |
| 4,384,488 | A | * | 5/1983 | Scheidweiler | 73/431 |
| 4,388,617 | A | * | 6/1983 | Nakanishi et al. | 340/594 |
| 5,132,659 | A | * | 7/1992 | Kuo | 340/326 |
| 5,684,467 | A | | 11/1997 | Hur | 340/693 |

FOREIGN PATENT DOCUMENTS

| | | | | |
|---|---|---|---|---|
| EP | 0346152 | | 12/1989 | |
| EP | 509 840 | A2 * | 4/1992 | 340/328 |
| EP | 0509840 | | 10/1992 | |
| GB | 2306218 | | 4/1997 | |
| JP | 09044767 | | 2/1997 | |

* cited by examiner

*Primary Examiner*—Jeffery Hofsass
*Assistant Examiner*—Hung Nguyen
(74) *Attorney, Agent, or Firm*—Fish & Richardson P.C.

(57) ABSTRACT

A sounder assembly comprising a housing, means for providing a sounder plate; a base for attaching the sounder assembly to a support surface, and an electrical sounder mounted generally within the housing, the arrangement being such that, in use, the sounder plate is spaced from the housing and is located between the housing and the support surface, with the electrical sounder facing the sounder plate such that sound is generated towards the sounder plate and is directed away from the housing so that the sound emerges generally laterally of the sounder plate, and wherein the sounder plate is concave and the center of the electrical sounder is displaced from the center of the sounder housing.

22 Claims, 2 Drawing Sheets

SOUNDER DEVICE WHICH DEFLECTS SOUND AWAY FROM A HOUSING

This invention relates to a sounder. In particular, it relates to a sounder for an alarm system such as a fire or intruder alarm system.

EP 0509840 discloses a sounding device for using such a system in which an electrical sounding device is mounted in a housing and spaced a distance from a sounder plate so that sound is generated by the sounding device and is directed away so that the sound emerges laterally. The sounding device is one which may have a further electrical device, such as a detector or a light, mounted on top of the sounder. The device is arranged so that the sounder plates lies between the mounting part for the sounder and any additional detector or other apparatus. Thus, if the sounding device is attached to a ceiling, the sounder faces away from the ceiling.

It is desirable to encapsulate components such as electronic components and also the sounders in such devices and, with the apparatus shown in EP 0509840 it is necessary to use two encapsulation processes. The sounder must be encapsulated from its rear (ie. from the surface nearest the ceiling or other support) and the electronic components are encapsulated from the upper side.

The present invention arose in an attempt to provide an improved sounder of the type which can be used on its own, or with an additional electrical component mounted on it.

According to the present invention there is provided a sounder assembly comprising a housing, means for providing a sounder plate; a base for attaching the sounder assembly to a support surface such as a ceiling or wall, and an electrical sounder mounted generally within the housing, the arrangement being such that, in use, the sounder plate is spaced from the housing and is located between the housing and the support surface, with the sounder facing the sounder plate such that sound is generated towards the sounder plate and is directed away from the housing so that the sound emerges generally laterally of the sounder plate, and wherein the centre of the sounder is displaced from the centre of the sounder housing.

Thus, the sounder is positioned to emit sound initially towards the ceiling or other support surface, ie the sounder is inverted.

Preferably, the sounder plate is integral with the base.

The sounder is preferably positioned at an angle other than 90° to axis of the assembly.

The sounder plate is preferably concave and the sounder is positioned at a position displaced from the centre of the housing at an angle which generally matches (ie is generally parallel to) the angle of the sounder plate at that position.

According to the present invention there is further provided a sounder assembly including any one or more of the novel features described herein.

Embodiments of the present invention will now be described, by way of example only, with reference to the accompanying drawings, in which.

It should be noted that the drawings and description are actually shown inverted for clarity. Generally, the term bottom in this specification means nearer to a ceiling, wall or other supporting structure and top means further therefrom and would usually be reversed in practice.

Figure 1:
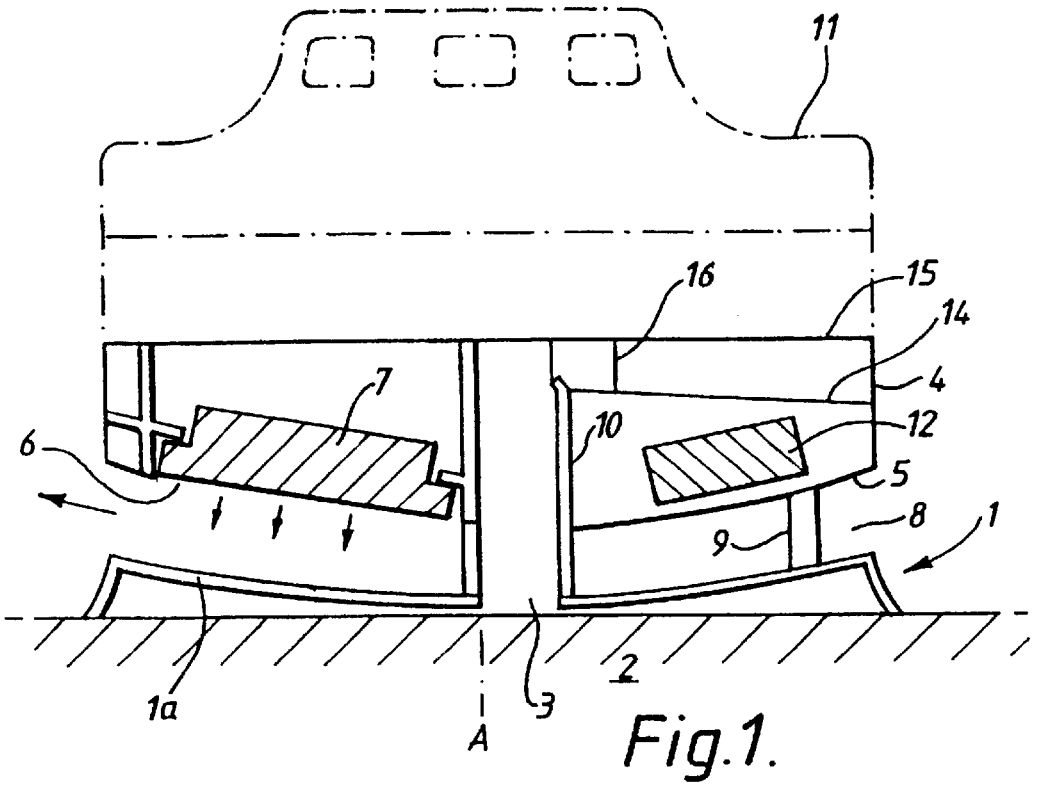
FIG. 1 shows schematically a sounder according to the present invention.
Figure 2:
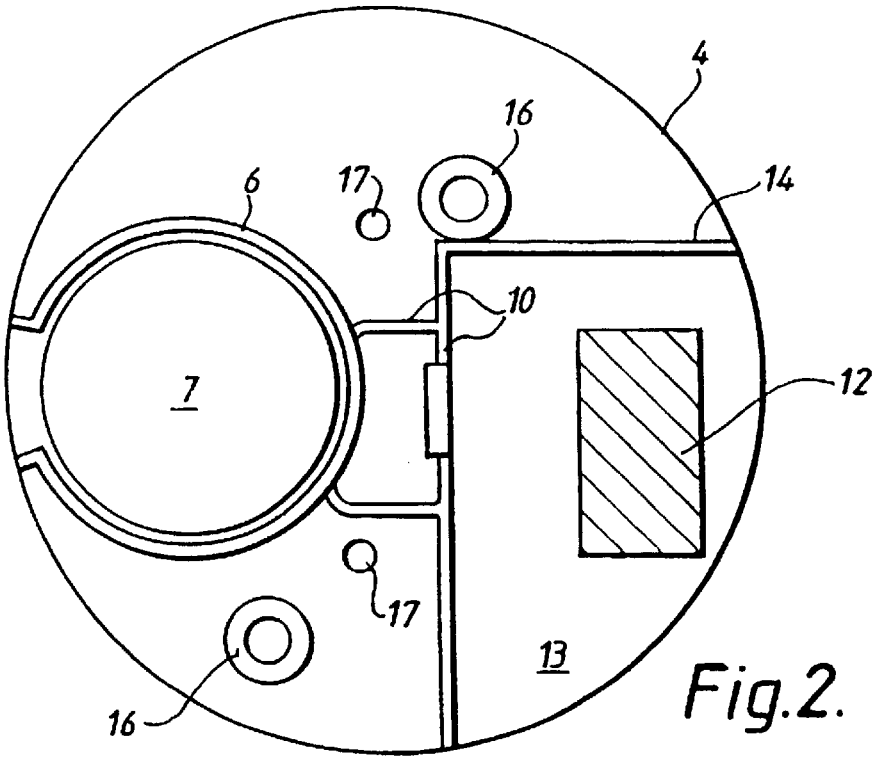
FIG. 2 shows a top view of the sounder.

Referring to FIG. 1, a sounder assembly is shown schematically in cross-section and comprises a base 1 which mounts against a support surface such as a ceiling 2. The base has side walls which are flared in the example shown but which may be straight or other configuration. A generally domed, concave portion 3 is shown between the side walls and this forms a sounder plate for the sounder. Thus, in the example shown, the sounder plate is integral with the base plate but in other embodiments the sounder plate may be an additional plate which may be attached to a base plate but in any case lies between the sounder and support surface (ceiling). Sounder plate/base plate 1 is provided with an aperture 3, the edge of which may line up with central axis A. This aperture enables external cabling to be applied and may be generally rectangular, or otherwise shaped.

Where separate sounder plates and base plates are used, the base plate may be arranged to be affixed to the sounder plate and to a support surface, and may, of course, also have an aperture for cabling, etc. The base may be a separate moulding, for example.

A sounder housing 4 has an undersurface which is also generally domed in a concave manner, so as to match and have generally constant spacing from the upper surface of base plate 1. Domed lower surface 5 is provided with a first, circular, aperture 6 in which a sounder 7 sits, in such a disposition as to emit sound towards sounder plate 1 and thence outwardly through a gap 8 between the sounder plate and the housing. The housing is spaced from the sounder plate by one or more spacers 9 and also includes an aperture defined by vertical walls 10 of similar disposition to the walls forming aperture 3, so that, when the device is assembled, walls 10 are in register with the walls forming aperture 3 to provide a through aperture, to enable cabling from an external source to pass through the base, through the housing and to any electrical component which may be placed on top of the housing. Such a component is shown by dashed lines 11 representing a detector, but other components, such as lights or other components, may be used. Alternatively, the sounder may be used on its own, in which case a blanking cap may be placed on top of it.

As shown, the sounder is further from the ceiling than the sounder plate, as compared to prior art designs in which the sounding plate was mounted above the housing (that is, remote from the ceiling, or other supporting surface, with respect to the housing). The sounder emits its sound towards the sounding plate and thereby towards the ceiling. The sounder is positioned at an angle to the central axis A of less than 90° so that it lies preferably generally parallel to the part of the sounding plate which it overlies.

Control electronics 12 may be placed within an enclosure 13 defined by internal walls 14 of the housing. A peripheral wall 15 extends around the periphery of the housing. The, or some of, internal walls 14 may be of lower height than wall 15 (as indicated in FIG. 1) and these enable cabling, taken through apertures 3 and 10 to be taken over the top of walls 14 to be connected to electronic circuit 12. The cabling may also pass straight through and be connected to an external device as described above.

An important advantage of the disposition of the sounder is that it enables encapsulation of the product to be done at a single process. Encapsulation of a sounder must, of course, be done from its rear and in prior art systems two separate encapsulation steps for the sounder and electronics were necessary. In the present invention, both the sounder 7 and the electronics 12 can be encapsulated from the top (ie. the face away from the ceiling when the device is placed in situ) so that the resin or other encapsulating material can be applied in one step. A terminal block may be applied for connection of an external device.

Bosses 16 are included in the structure of the housing and these enable a component such as detector 11 to be mounted and positioned. The housing and the base may also include holes 17 to enable them to be secured by screws or otherwise to a ceiling.

It has been found to be greatly advantageous to offset the position of the sounder 7 from the central axis A to enable better access for cabling through the centre of the sounder assembly. It is also advantageous to use the dome structure and to position the sounder at an angle of 90° to axis A. Instead of domed surfaces 5 and 1*a*, the surfaces may instead be conical, or otherwise arranged so that their angles, or the angles of the parts directly underlying the sounder, are at an angle other than 90° (preferably less than 90°) to the axis of the assembly (perpendicular to the plane of the ceiling, wall or other support surface).

Figure 3:
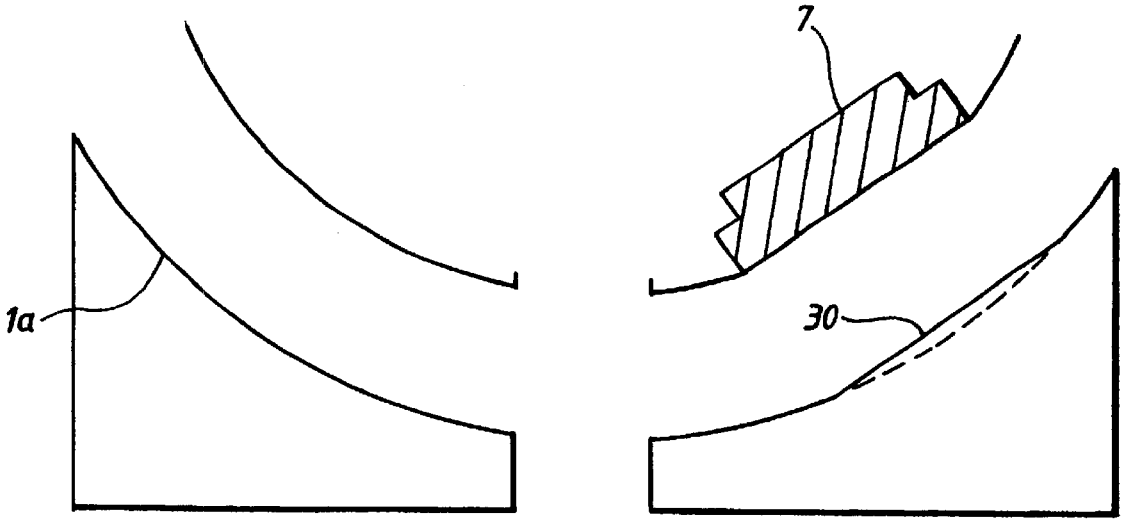
FIG. 3 shows an alternative embodiment.

As shown in FIG. 3, the sounder plate may alternatively be provided with a flat portion 30, adjacent the mounting portion of the sounder, with the sounder mounted at a similar angle to that of the flat portion. The dotted line in the figure merely shows the continuation of the curve of the remainder of the sounder plate 1*a*, although this need not be curved (the curve in the figure has been exaggerated for clarity). More than one flat portion may be provided. The flat portion may alternatively extend as a radial band on the sounder plate, enabling the sounder body to be installed at any angular position so that the sounder lies adjacent to part of the radial band.

As illustrated in FIG. 1, the construction of a sounder assembly according to the present invention enables the assembly to be of the same diameter as a detector 11 mounted on it. This results in an attractive structure of more flowing lines. Previous combined sounders/detectors tended to have sounders/sounder bases which were wider than the detector part.

What is claimed is:

1. A sounder assembly comprising a housing, means for providing a sounder plate; a base for attaching the sounder assembly to a support surface, and an electrical sounder mounted generally within the housing, the arrangement being such that, in use, the sounder plate is spaced from the housing and is located between the housing and the support surface, with the electrical sounder facing the sounder plate such that sound is generated towards the sounder plate and is directed away from the housing so that the sound emerges generally laterally of the sounder plate, and wherein the sounder plate is concave and the center of the electrical sounder is displaced from the center of the sounder housing.

2. A sounder assembly as claimed in claim 1, wherein the electrical sounder is disposed with its face at an angle other than 90° to a central axis of the assembly.

3. A sounder assembly as claimed in claim 2, wherein the electrical sounder is disposed at an angle which generally matches the angle of the sounder plate at that position.

4. A sounder assembly as claimed in claim 2, wherein the sounder plate is disposed so that at least the part of it directly adjacent the electrical sounder is at an angle other than 90° to the central axis of the assembly, and the electrical sounder is disposed at an angle which generally matches the angle of said part of the sounder plate at that position.

5. A sounder assembly as claimed in claim 1, wherein at least part of the sounder plate adjacent the electrical sounder is a flat portion.

6. A sounder assembly as claimed in claim 5, wherein the flat portion is formed by a flat radial band.

7. A sounder assembly as claimed in claim 4, wherein the sounder plate is conical.

8. A sounder assembly as claimed in claim 1, wherein the sounder plate is integral with the base.

9. A sounder assembly as claimed in any of claims 1 to 8, wherein the sounder plate is a separate component to the base.

10. A sounder assembly as claimed in claim 1, wherein the electrical sounder and any other components in the assembly which are encapsulated, are encapsulated from the same side.

11. A sounder assembly as claimed in claim 2, wherein the sounder plate is integral with the base.

12. A sounder assembly as claimed in claim 3, wherein the sounder plate is integral with the base.

13. A sounder assembly as claimed in claim 4, wherein the sounder plate is integral with the base.

14. A sounder assembly as claimed in claim 5, wherein the sounder plate is integral with the base.

15. A sounder assembly as claimed in claim 6, wherein the sounder plate is integral with the base.

16. A sounder assembly as claimed in claim 7, wherein the sounder plate is integral with the base.

17. A sounder assembly as claimed in claim 2, wherein the sounder plate is a separate component to the base.

18. A sound assembly as claimed in claim 3, wherein the sounder plate is a separate component to the base.

19. A sound assembly as claimed in claim 4, wherein the sounder plate is a separate component to the base.

20. A sound assembly as claimed in claim 5, wherein the sounder plate is a separate component to the base.

21. A sound assembly as claimed in claim 6, wherein the sounder plate is a separate component to the base.

22. A sound assembly as claimed in claim 7, wherein the sounder plate is a separate component to the base.

* * * * *